US007179049B2

(12) United States Patent
Glasspoole

(10) Patent No.: US 7,179,049 B2
(45) Date of Patent: Feb. 20, 2007

(54) GAS TURBINE GAS PATH CONTOUR

(75) Inventor: David Glasspoole, St. Lambert (CA)

(73) Assignee: Pratt & Whitney Canada Corp., Longueuil (CA)

( * ) Notice: Subject to any disclaimer, the term of this patent is extended or adjusted under 35 U.S.C. 154(b) by 128 days.

(21) Appl. No.: 11/008,187

(22) Filed: Dec. 10, 2004

(65) Prior Publication Data

US 2006/0127214 A1 Jun. 15, 2006

(51) Int. Cl.
*F01D 25/00* (2006.01)

(52) U.S. Cl. ..... 415/191; 415/199.5; 415/211.2; 416/193 A

(58) Field of Classification Search ..... 415/191, 415/199.5, 211.2; 416/193 A
See application file for complete search history.

(56) References Cited

U.S. PATENT DOCUMENTS 3,661,475 A 5/1972 Anderson et al.
4,648,792 A * 3/1987 Baran et al. ..... 415/139
4,820,116 A * 4/1989 Hovan et al. ..... 415/115
4,889,469 A * 12/1989 Wilkinson ..... 415/191
5,236,302 A 8/1993 Weisgerber et al.
5,472,313 A 12/1995 Quinones et al.
5,484,258 A 1/1996 Isburgh et al.
5,545,004 A 8/1996 Ho et al.
5,630,703 A 5/1997 Hendley et al.
5,749,705 A 5/1998 Clarke et al.
6,059,525 A * 5/2000 Jiomacas et al. ..... 415/173.1
6,077,035 A 6/2000 Walters et al.
6,082,961 A 7/2000 Anderson et al.
6,183,197 B1 2/2001 Bunker et al.

* cited by examiner

*Primary Examiner*—Ninh H. Nguyen
(74) *Attorney, Agent, or Firm*—Ogilvy Renault LLP

(57) ABSTRACT

Gas flow is redirected by a feature disposed on a trailing edge of at least one segment of a peripheral gas path defining surface to improve alignment with a downstream portion of the gas path.

15 Claims, 4 Drawing Sheets

GAS TURBINE GAS PATH CONTOUR

TECHNICAL FIELD

The invention relates to gas turbine engine design and, in particular, reducing gas path pressure losses in a gas turbine engine.

BACKGROUND OF THE ART

Without question, the design of an efficient gas turbine engine is an exercise in compromise. Gas paths are designed to maximize work output, minimize losses, extend component life, and operate reliably. To maximize the work obtained from the flow, aerodynamics typically prevail through the provision of an expanding and curving gas path through the turbine section. This curvature inevitably results in pressure losses, however the penalty is necessary to optimize efficiency. There is room for improvement, however, as it is desirable to reduce losses while still maximizing the work done by the turbine. Often however, the designer is limited in what he or she can do, without disrupting the complex optimization of the turbine design.

SUMMARY OF THE INVENTION

In one aspect the invention provides a component for a gas turbine engine, the engine defining a primary gas path including at least two adjacent sections, a first of said sections channelling gases in a first general direction and a second of said sections channelling gases in a second general direction, the second section disposed downstream of the first, the first and second general directions different from one another, the component comprising a primary gas path defining surface, the surface being a circumferential portion of an annular surface of revolution, the surface providing a portion of said first section and generally aligned in the first general direction, the surface co-operating with at least a pair of spaced-apart airfoils to define an aerodynamic throat therebetween, the surface including a lip portion located downstream of the throat, the lip portion generally aligned with the second general direction.

In a second aspect the invention provides a component for a gas turbine engine, the engine defining a primary gas path including at least two adjacent sections, a first of said sections channelling gases in a first general direction and a second of said sections channelling gases in a second general direction, the second section disposed downstream of the first, the first and second general directions different from one another, the component comprising a primary gas path defining surface, the surface being a circumferential portion of an annular surface of revolution, the surface providing a portion of said first section and generally aligned in the first general direction, the surface co-operating with at least a pair of spaced-apart airfoils to define an aerodynamic throat therebetween, the surface including means for redirecting gas flow thereover to the second direction, said means located downstream of the throat.

Further details of the invention and its advantages will be apparent from the detailed description included below.

BRIEF DESCRIPTION OF THE DRAWINGS

In order that the invention may be readily understood, examples of the invention are illustrated in the accompanying drawings, in which.

DETAILED DESCRIPTION OF PREFERRED EMBODIMENTS

Figure 1:
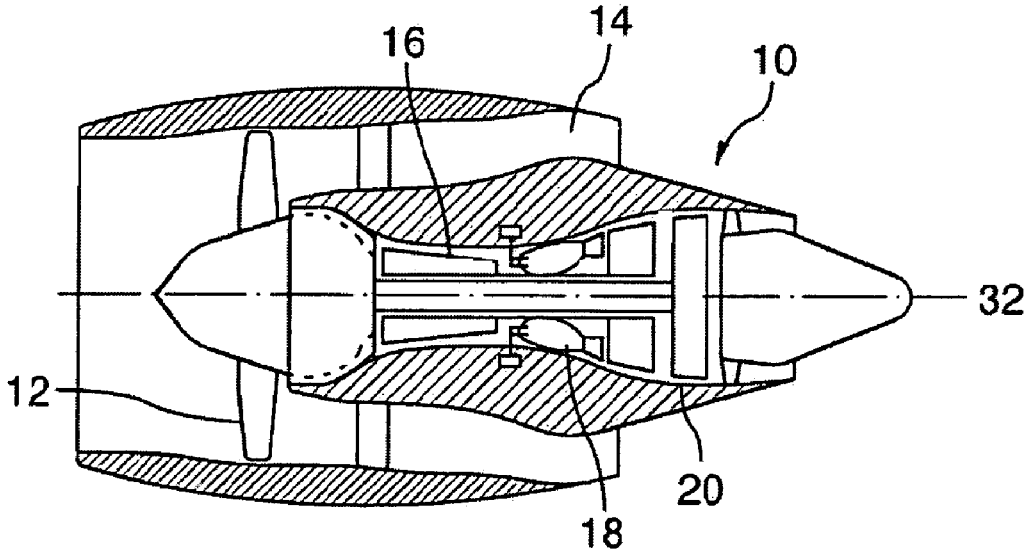
FIG. 1 is an axial cross-section through a turbofan gas turbine engine employing the invention.

FIG. 1 shows an axial cross-section through a turbofan gas turbine engine 10. It will be understood however that the invention may also be applied to any type of airborne or land-based gas turbine engine. Air intake into the engine passes over fan blades 12 is split into an outer annular flow through the bypass duct 14 and an inner flow through a compressor 16 to a combustor 18, where it is combusted and the resulting hot gases are expelled through the turbine section 20, which includes vanes 22 and turbine blades 24, before exiting the engine.

Figure 2:
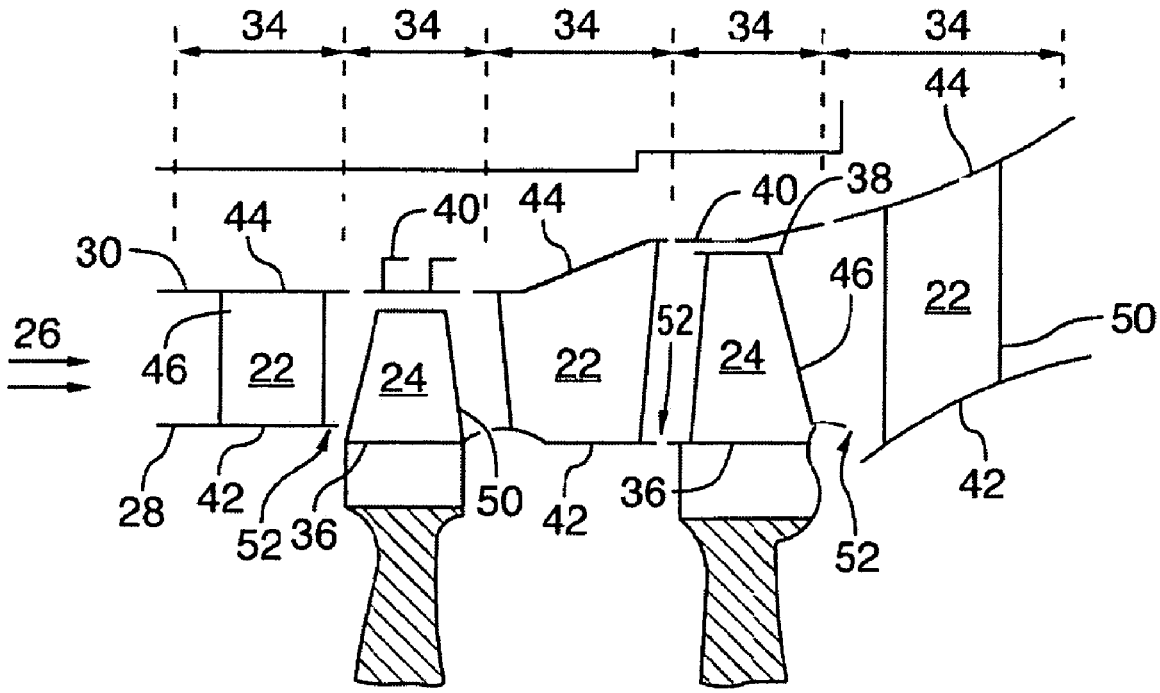
FIG. 2 is a axial sectional view through the turbine section of an engine according to the present invention.

Referring to FIG. 2, the turbine section has a gas path 26 defined therethrough which is generally annular and extends axially from the engine inlet to the exhaust (neither indicated). The gas path 26 is defined by an inner wall 28 and an outer wall 30 which each comprise a surface of revolution about the longitudinal engine axis 32 (reference FIG. 1). As best seen in FIG. 2, the gas path wall 28 and 30 are not continuous, although they are generally designed for optimal aerodynamic properties. Thus, the gas path 26 typically comprises a plurality of successive sections 34, wherein the direction and/or relative expansion or compression of the gas path changes relative to upstream and/or downstream sections 34. Successive sections 34, therefore, have general directions (i.e. the major direction in which the section is aligned, ignoring any local deviations) which are typically disposed at angles relative to the adjacent upstream and downstream sections 34. These direction changes, and relative expansion or contraction of the gas path shape, is typically provided to maximize work extracted from the turbine cycle, for example, or in the case of a compressor, maximize compression efficiency, etc.

The gas path walls 28 and 30 of sections 34 are defined by successive gas turbine components such as rotor blade platforms 36, blade tip shrouds 38, static shrouds 40, and vane platforms 42 and 44. The platforms 36, 42, and 44 and static shrouds 40 thus provide gas path defining surfaces 48, which direct air/combustion gases through the primary gas path. The general angle relative to the engine centreline 14 of the gas path as defined by each gas path defining surface 48 defines the overall shape of gas path 26. The blades and vanes each have airfoils 46 which have trailing edges 50. Together with airfoils 46, and in particular trialing edges 50, platforms 36, 42, and 44 and static shrouds 40 also respectively define a plurality of aerodynamic throats 52. The platforms 36, 42, and 44 and static shrouds 40 also have trailing edges 54, which are downstream of trailing edges 50 and thus throats 52.

Figure 3:
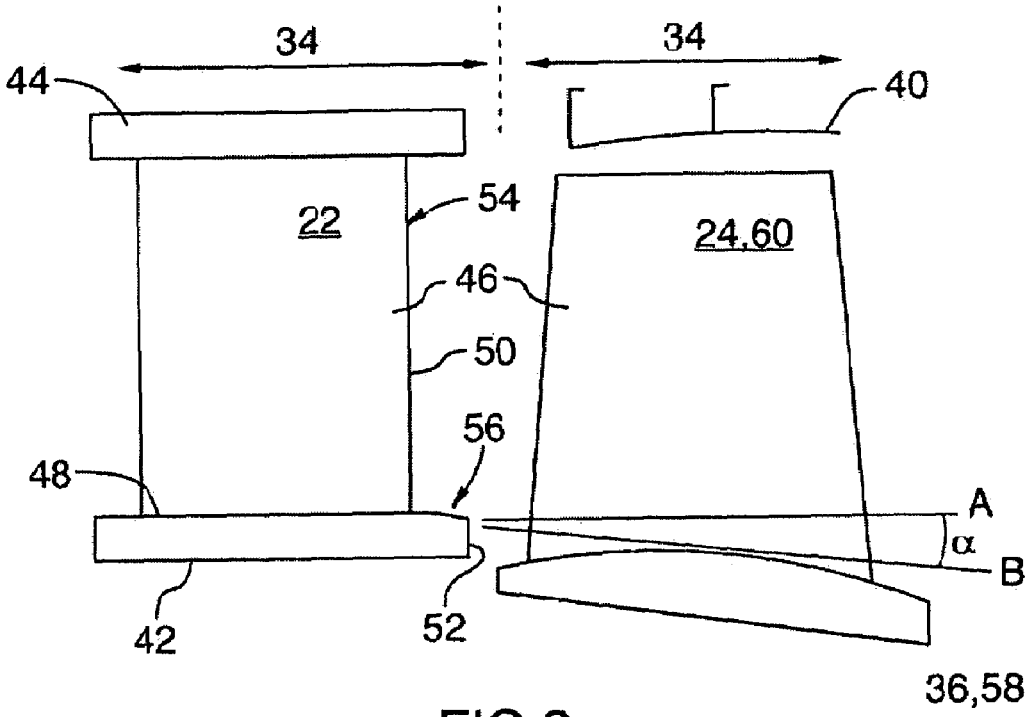
FIG. 3 is a schematic side view of a vane according to the present invention, followed by a downstream blade.
Figure 4:
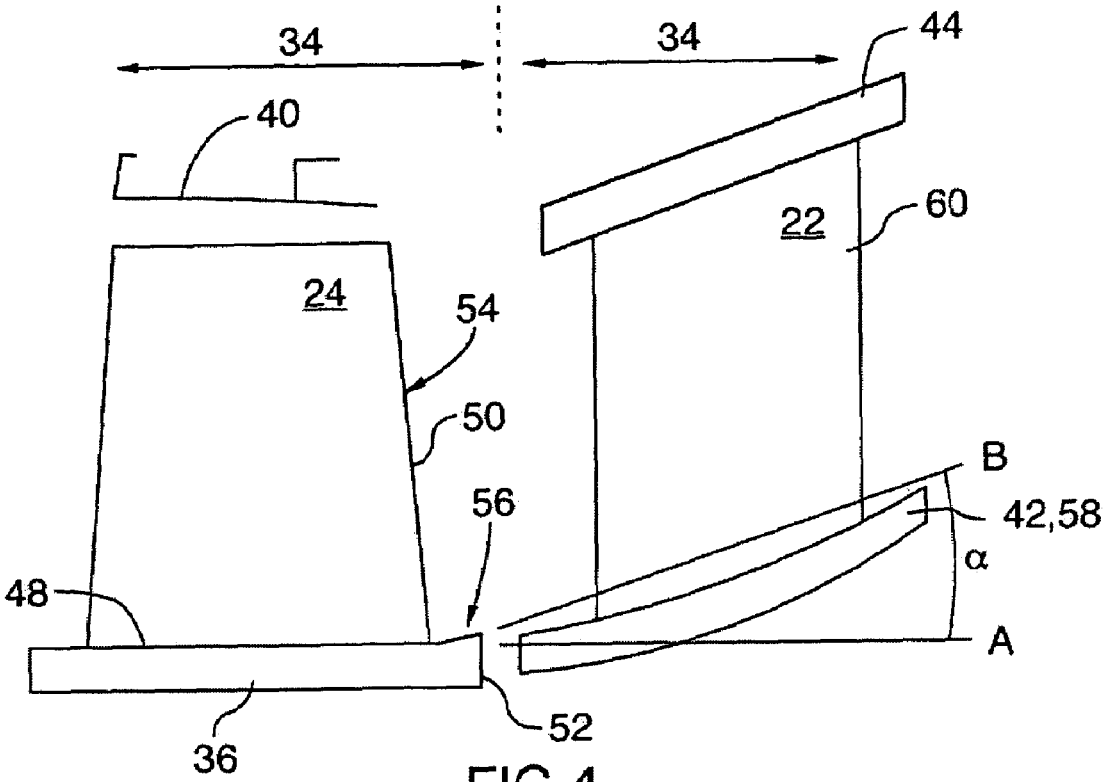
FIG. 4 is a schematic side view of a blade according to the present invention, followed by a downstream vane.

According to the present invention, the gas path defining surfaces 48 provided by platforms 36, 42, 44 and shrouds 40 and 38 may be provided with an integrally angled lip or gas flow redirector 56 adjacent a trailing edge thereof, downstream of an exit of aerodynamic throat 52. Referring to FIG. 3, vane platform 42 is shown with a downwardly angled lip 56. Referring to FIG. 4, blade platform 36 is provided with an upwardly angled lip 56. As indicated in FIGS. 3 and 4 with angle α, the lip 56 deviates from the general direction or shape "A" of the platform in a manner so as to redirect the airflow passing gas path defining surface 48 into better alignment with a general direction or shape "B" of a downstream platform 58 of downstream article 60 (in this case, a blade and vane, respectively), and thereby reduce losses associated with turbulence caused by airflow disruptions. Line "A" therefore represents the general direction of the upstream section 34, while line "B" represents the general direction of the downstream section 34, as it relates to the gas path wall 28, 30 of interest (i.e. the inner and outer walls 28, 30 may not have the same general direction). Referring again to FIG. 3, is can be seen that the general direction of the downstream section 34 (i.e. line B) is not necessarily the same as the local direction of the downstream section 34 immediately downstream of lip 56. Rather, lip 56 may redirect air past such local inconsistencies in direction, and towards the more global general direction provided in the downstream section 34.

It has been found that redirection of gas in advance of a change in general direction of the walls 28, 30 of the gas path reduces pressure losses and thereby helps to better optimize engine efficiency. As mentioned, the lip 56 is downstream of the aerodynamic throat 52, to thereby minimize any aerodynamic effects experienced at the throat (e.g. choking, etc.) and the present invention thereby interferes minimally, if at all, with the aerodynamic design of the gas path vis-à-vis maximizing work output from the combustion gases. Losses may therefore be reduced without affecting any macro design aspects of the gas turbine engine.

Figure 5:
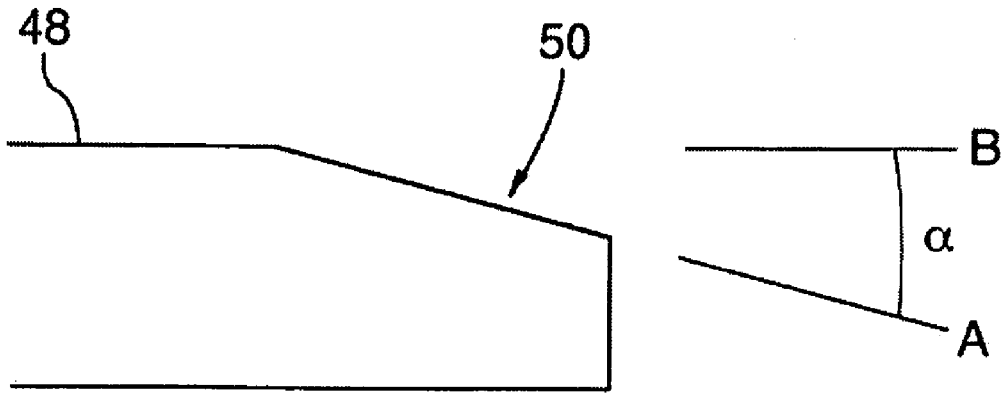
FIGS. 5 and 6 are enlarged views or portions of FIGS. 3 and 4, respectively.
Figure 6:
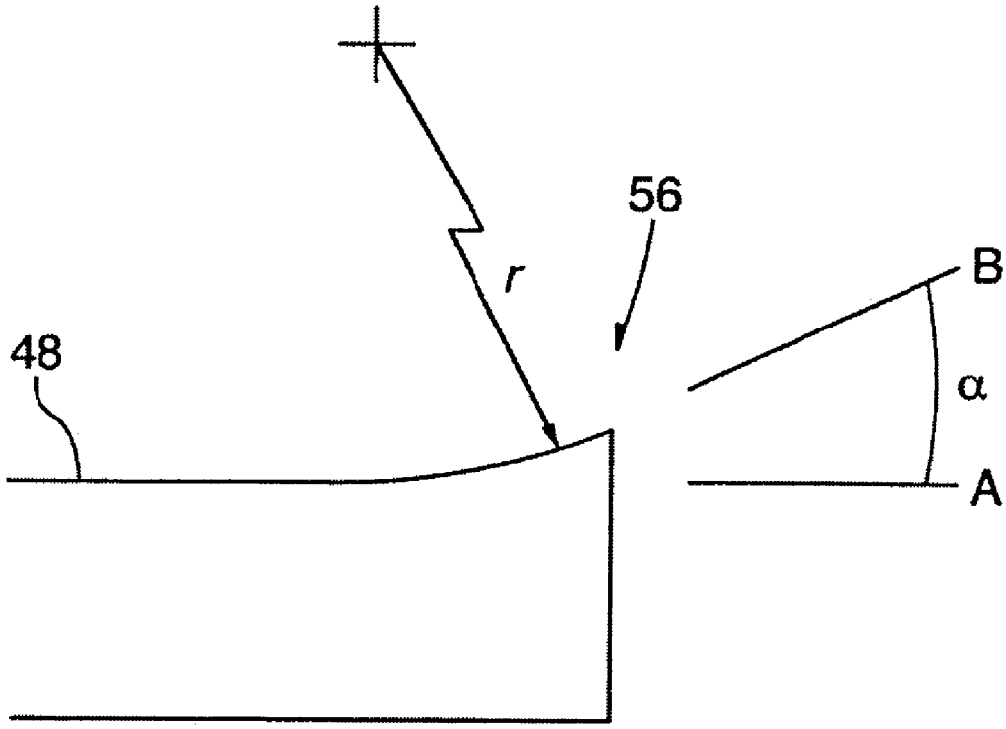
Figure 7:
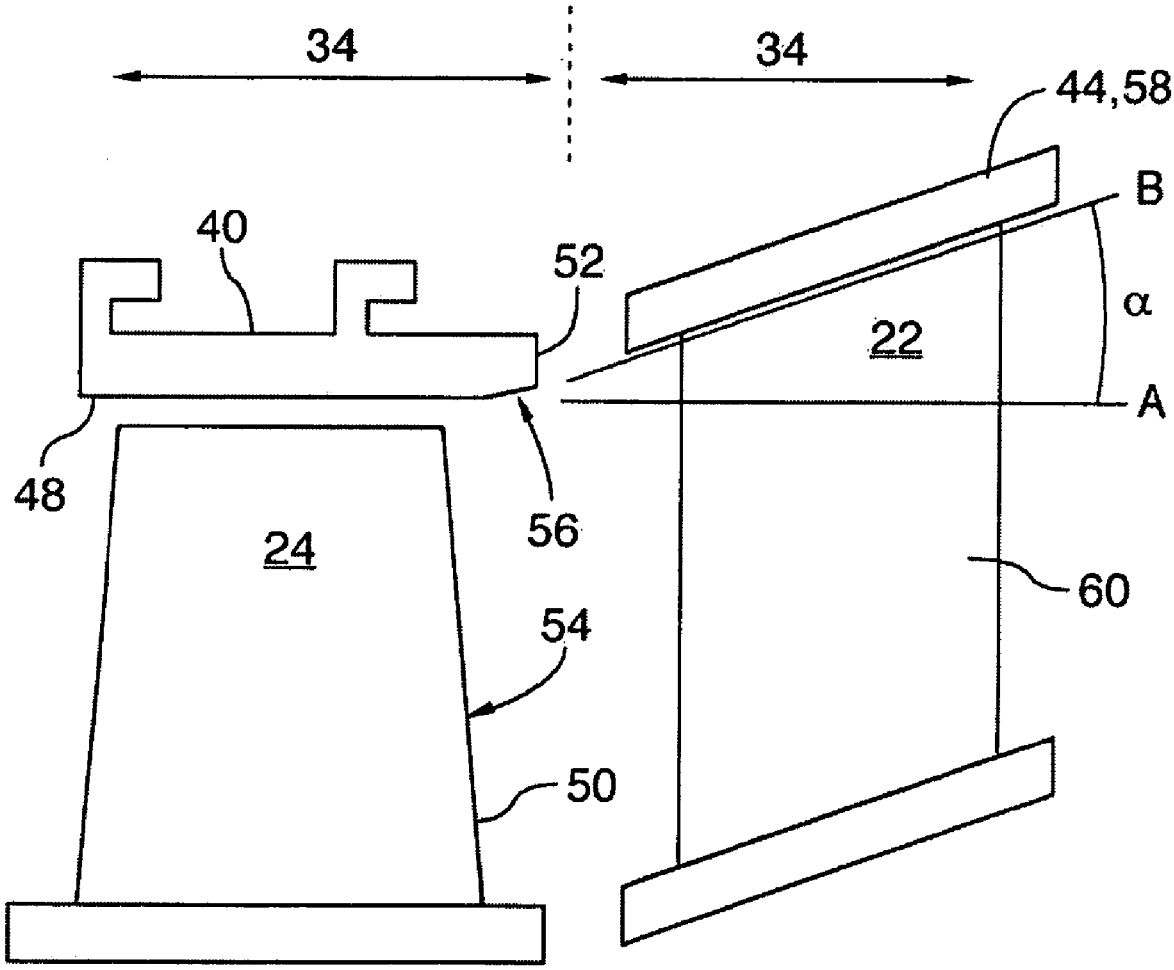
FIG. 7 is a view similar to FIGS. 3 and 4, showing a further embodiment incorporated in a static shroud, followed by a downstream vane.

As mentioned, the gas flow redirector lip 56 can be located at various and multiple positions in the engine. In the embodiments shown, the redirector lip 56 is shown on a radially inner surface of the gas path, however it will be appreciated that redirector lip 56 can also be used on an outer gas path surface in the turbine, such as the static shroud embodiment depicted in FIG. 7 or on a turbine blade shroud 38 (embodiment not depicted) and, likewise, the invention may be employed in a compressor or other areas of the gas turbine gas path, as well. The exact shape and angle of the lip 56 can be to the designer's preference. Referring to FIGS. 5 and 6, the active or redirecting surface of lip 56 may be a linear surface of revolution about the engine axis (i.e. appears "flat" in FIG. 5) or may be curved in the axial and/or circumferential directions on a suitable constant or variable radius r (i.e. appears "curved" in FIG. 6) as desired. It will be understood that the relative proportions of the lips 56 shown in the Figures have been exaggerated for illustration purposes, and that in fact the lip may only be a few thousandths of an inch in height. It will also be understood that a "lip" may protrude from the primary gas path defining surface 48, or may recess therefrom. Although the "A" direction is shown in each example as horizontal for ease of illustration, the skilled reader will appreciate that the invention may be applied to any relative "A" and "B" directions within the gas path.

The direction or angle provided to lip 56 preferably includes a slight over- or under-correction (as the case may be) so that gases are directed smoothly over the boundary layer region of the downstream section of the gas path, and preferably avoids any local obstacles or direction changes located between the lip 56 and the general direction provided by the downstream section.

Still other modifications will be apparent to the skilled reader which do not depart from the invention. Therefore, although the above description relates to a specific preferred embodiments as presently contemplated by the inventor, it will be understood that the scope of the present invention described herein is intended to be limited only by the appended claims.

I claim:

1. A component for a gas turbine engine, the engine defining a primary gas path including at least two adjacent sections, a first of said sections channelling gases in a first general direction and a second of said sections channelling gases in a second general direction, the second section disposed downstream of the first, the first and second general directions different from one another, the component comprising a primary gas path defining surface having a plurality of spaced-apart airfoils extending therefrom, the surface being a circumferential portion of an annular surface of revolution, the surface defining a peripheral portion of said first section and generally aligned in the first general direction, the surface co-operating with at least a pair of said spaced-apart airfoils extending therefrom to define an aerodynamic throat therebetween, the surface including a lip portion entirely downstream of the throat, the lip portion generally aligned with the second general direction.

2. The component of claim 1 wherein the lip portion extends to a trailing edge of the component.

3. The component of claim 2 wherein the trailing edge defines a boundary between the first and second sections.

4. The component of claim 1 wherein the lip portion commences substantially at a terminal point of the throat.

5. The component of claim 1 wherein the lip portion is generally linear surface of revolution about an engine axis.

6. The component of claim 1 wherein the lip portion is a curvilinear surface of revolution about an engine axis.

7. The component of claim 1 wherein the lip of the primary gas path defining surface is slightly misaligned with the second general direction so that gases are directed smoothly over a boundary layer region between the first and second sections.

8. A component for a gas turbine engine, the engine defining a primary gas path including at least two adjacent sections, a first of said sections channelling gases in a first general direction and a second of said sections channelling gases in a second general direction, the second section disposed downstream of the first, the first and second general directions different from one another, the component comprising a primary gas path defining surface having a plurality of spaced-apart airfoils extending therefrom, the surface being a circumferential portion of an annular surface of revolution, the surface defining a peripheral portion of said first section and generally aligned in the first general direction, the surface co-operating with at least a pair of said spaced-apart airfoils extending therefrom to define an aerodynamic throat therebetween, the surface including means for redirecting gas flow thereover to the second direction, said means located entirely downstream of the throat.

9. The component of claim 8 wherein said means extends from the throat to a trailing edge of the component.

10. The component of claim 8 wherein said means include misalignment means for directing gases smoothly over a boundary layer region between the first and second sections.

11. A method of increasing gas flow efficiency in a gas turbine engine, the engine defining a primary gas path including at least two adjacent sections, a first of said sections channelling gases in a first general direction and a second of said sections channelling gases in a second general direction, the second section disposed downstream of the first, the first and second general directions different from one another, the component comprising a primary gas path defining surface, the surface being a circumferential portion of an annular surface of revolution, the surface defining a peripheral portion of said first section and generally aligned in the first general direction, the surface having a pair of spaced-apart airfoils extending therefrom to define an aerodynamic throat therebetween, the method including one of increasing and decreasing a radial dimension said surface to define a lip portion located entirely downstream of the throat, the lip portion generally aligned with the second general direction, wherein the lip portion extends to a trailing edge of the component and defines a boundary between the first and second sections.

12. The method of claim 11 further comprising the step of misaligning the lip with the downstream direction to direct gases smoothly over a boundary layer region between the first and second sections.

13. The method of claim 11 wherein the lip portion commences substantially at a terminal point of the throat.

14. The method of claim 11 wherein the lip portion is generally linear surface of revolution about an engine axis.

15. The method of claim 11 wherein the lip portion is a curvilinear surface of revolution about an engine axis.

* * * * *